US005584908A

United States Patent [19]

Scheie

[11] Patent Number: 5,584,908

[45] Date of Patent: Dec. 17, 1996

[54] MICRON-SIZED NICKEL METAL POWDER AND A PROCESS FOR THE PREPARATION THEREOF

[75] Inventor: Hugh C. Scheie, St. Albert, Canada

[73] Assignee: Sherritt Inc., Fort Saskatchewan, Canada

[21] Appl. No.: 340,330

[22] Filed: Nov. 14, 1994

[51] Int. Cl.[6] ..... B22F 1/00

[52] U.S. Cl. ..... 75/374; 75/348

[58] Field of Search ..... 75/348, 374

[56] References Cited

U.S. PATENT DOCUMENTS 3,156,556 11/1964 Meddings et al. ..... 75/0.5
3,399,050 8/1968 Evans et al. ..... 75/0.5

FOREIGN PATENT DOCUMENTS 166132 11/1955 Australia ..... 75/374

OTHER PUBLICATIONS

"Effect of Addition Agents on the Properties of Nickel Powders Produced by Hydrogen Reduction" By W. Kunda, D. J. I Evans and V. N. Mackiw Date–1965 Full copy.

*Primary Examiner*—John Sheehan
*Attorney, Agent, or Firm*—Arne I. Fors; Jeffrey T. Imai; Doak D. Horne

[57] ABSTRACT

A process is provided for the production of a nickel metal powder by reduction of an ammoniacal nickel (II) carbonate solution essentially free of metallic nickel. A soluble silver salt is added in an amount to provide a soluble silver to nickel weight ratio of 1.0 to 10.0 grams per kilogram of nickel, an organic dispersant, such as gelatin, is added in the amount of 5.0 to 20.0 grams per kilogram of nickel Ni (II), together with a spheroid-promoting agent such as anthraquinone in an amount of about 1.0 to 5.0 grams per kilogram of nickel. The solution is heated to a temperature in the range of 150° to 180° C., with agitation, under a hydrogen pressure of about 3.5 MPa for a time sufficient to reduce the ammoniacal ammonium nickel (II) carbonate solution to micron-sized nickel metal powder. A high purity, micron-sized nickel metal powder of generally spheroid particulate configuration is produced. The nickel metal powder has an average particle size of about 0.5 microns. The metal powder is characterized in having an iron impurity content of less than 100 ppm.

14 Claims, 4 Drawing Sheets

FIG.1. (PRIOR ART PROCESS)

MICRON-SIZED NICKEL METAL POWDER AND A PROCESS FOR THE PREPARATION THEREOF

FIELD OF THE INVENTION

The present invention relates to a novel, micron-sized nickel metal powder and to a process for the production thereof. Furthermore, the invention also provides a method of controlling the particulate size of the produced nickel metal powder.

BACKGROUND OF THE INVENTION

A method for the production of nickel metal powder from basic nickel carbonate by reduction with gaseous hydrogen at elevated temperatures and pressures is disclosed in U.S. Pat. No. 3,399,050 to D. J. I. Evans et al. The process utilizes a concentrated ammoniacal solution of nickel ammonium carbonate which is initially diluted with water and then boiled to remove excess ammonia and carbon dioxide. This results in the precipitation of basic nickel carbonate (BNC), i.e. a mixture of nickel hydroxide and nickel carbonate, leaving essentially no nickel ions in solution. This slurry is then charged to the autoclave, heated to temperature and reduced with hydrogen. The nickel powder is effectively formed by direct reduction of the solid BNC.

This prior an procedure deleteriously yields a powder containing some entrained, or encapsulated BNC, which results in a lower specific gravity and increased levels of oxygen and carbon which are unacceptable for certain applications. Additionally, the prior art process is difficult to control to yield consistent results, since the boiling step produces variable results.

The prior an process has always used a combination of ferrous sulphate and aluminum sulphate as the catalyst, but the iron content of up to 4000 ppm, or the high total metallic impurity (up to 0.8% ) in the nickel metal powder precludes its use in certain applications.

In the paper entitled "Effect of Addition Agents on the Properties of Nickel Powders Produced by Hydrogen Reduction" by W. Kunda, D. J. I. Evans and V. N. Mackiw in "Modern Developments in Powder Metallurgy. Vol. I: Fundamentals and Methods" Hausner, H, H, and Roll, K;. H. eds. (New York: Plenum Press, 1966), 15–49, there is detailed a discussion of a wide variety of alternative catalysts and additives and their effects in modifying the physical properties of the nickel powder produced.

During recent years, fine nickel powders have been produced commercially for use in electronic circuitry, fuel cells and numerous other usages. However, in certain specialized applications, exemplary of which are conductive pastes used in capacitors and the like, it has been found unacceptable to utilize the existing available nickel powders in such pastes because of the high level of impurities, for example, iron, alkali metals, carbon and oxygen which deleteriously affect conductivity. Thus, at present, the industry is using fine powders prepared from alloys of the platinum group metals, gold and silver in the formulation of such pastes. As will be readily appreciated, the smaller the particle size, the thinner the layer of paste which will be required for the substrate. Clearly, too, a spherical particulate configuration is sought after to thereby provide tighter packing concomitant with a layer of increased conductivity. Therefore, it is an objective of the present invention to provide an equally effective, but less costly replacement for the metals in current usage.

Additionally, it is an object of this invention to provide a process for preparing micron-sized, spheroidal nickel metal powder having higher purity, and a production process exhibiting improved reproducibility.

SUMMARY OF THE INVENTION

In accordance with a first aspect of the present invention there is provided a novel, micron-sized nickel metal powder having a nickel content greater than 99% wherein the metal particles are of a generally spheroidal configuration. The preselected particle sizes of the nickel metal powder are in the range of 0.3 to 2.0 μm, and in a preferred aspect, the particle sizes are less than 1.0 μm. The content of such undesirable trace impurities as iron, cobalt, aluminum, carbon, sulphur and oxygen has been greatly reduced, the nickel metal powder being characterized in having an iron content lower than 100 ppm.

More particularly, the chemical and physical properties of the nickel metal powders of the invention are as follows: a chemical composition which comprises nickel in the range of about 99 to 99.5 weight percent and contains impurities comprising iron in the range of about 0.001 to 0.010 weight percent; aluminum in the range of about 0.001 to 0.005 weight percent; sulphur in the range of about 0.001 to 0.01 weight percent; oxygen in the range of about 0.3 to 0.8 weight percent; carbon in the range of about 0.1 to 0.4 weight percent and silver in the range of about 0.01 to 0.2 weight percent. The physical properties of the nickel metal powder include having a surface area in the range of about 0.5 to 3.0 square meters per gram; an apparent density in the range of about 1.0 to 2.0 g/cc; a tap density in the range of about 2.0 to 4.0 g/cc; whereby said nickel metal powder possesses micron-sized particles ranging from between about 0.3 to 1.5 μm which are of a generally spheroidal configuration.

The most preferred chemical and physical properties of the micron-sized nickel metal powder are given below. The chemical composition comprises nickel of about 99.0 weight percent and includes impurities comprising oxygen less than 0.8 weight percent; and silver less than 0.3 weight percent. The physical properties of the nickel metal powder include having a surface area in the range of about 1.0 to 3.0 square meters per gram; an apparent density in the range of about 1.0 to 2.0 g/cc; a tap density in the range of about 2.0 to 4.0 g/cc; whereby said nickel powder particles possess a micron size ranging from between about 0.3 to 0.5 μm and are of a generally spheroidal configuration.

It is also to be noted, without being bound by same, that the nickel metal powder product of the instant invention is essentially free of entrained or encapsulated BNC and is believed, because of the observed high specific gravity, to be substantially metal powder.

As a result the thus produced spheroidal nickel metal powder particles are particularly well adapted for the formulation of conductive pastes, and advantageously may be utilized in the replacement of the alloys of platinum group metals, gold or silver previously used in certain commercial applications.

It is to be understood, however, that the utility of the powder is not to be limited to the above-described application but will be found suitable for any use requiring a micron-sized nickel metal powder of this purity, composition and morphology.

In a second broad aspect of the invention there is provided a process for the preparation of a micron-sized nickel metal powder.

The process, in contradistinction to the prior art processes, commences with a diluted ammoniacal nickel (II) solution, preferably a diluted ammoniacal nickel (II) carbonate solution, wherein neither the $CO_2$ nor $NH_3$ have been permitted to boil or partially boil out. The solution is clarified or filtered to ensure that only soluble nickel ions are being charged into the autoclave. A silver compound is added to the filtered ammoniacal nickel (II) carbonate-containing solution to obtain a soluble silver to nickel (II) weight ratio in the range of about 1.0 to 10.0 grams per kilogram of nickel (II). An organic dispersant in an amount functional to control agglomeration of the resultant nickel metal powder and an organic, spheroid-promoting compound in an amount effective to maximize the configuration of the nickel metal powder are also added. The catalytic reagents, namely, silver, dispersant and spheroid-promoting agent, are added following the clarification/filtration step while the solution is charged to the autoclave. The solution is heated, with agitation, optionally with a hydrogen overpressure in the range of 150 to 500 kPa, to a temperature in range of 150° C. to 180° C., and then reacted with hydrogen at a pressure of 3.0 to 4.0 MPa (i.e., 450 to 600 psi) for a time sufficient to reduce the dissolved nickel to form a micron-sized nickel metal powder.

As will be described herebelow, the ratio of the soluble silver to nickel content in the nickel metal plays a critical role in controlling the nickel powder particle size. The weight ratio of the added silver to nickel (II) ranges from 1.0 g to 10.0 grams per kilogram of nickel, and, most preferably, ranges from 1.0 to 2.5 grams per kilogram of nickel.

Preferably, the anti-agglomeration agent is selected from suitable organic compounds, such as gelatin and/or bone glue.

A suitable organic compound functional to improve spheroidal morphology includes anthraquinone, or derivatives thereof, or alizarin alone or in admixture with anthraquinone.

Additionally the application of a low hydrogen overpressure during the heating stage yields a powder having superior properties.

The preferred process for the preparation of a micron-sized nickel metal powder from an ammoniacal nickel (II)-containing solution is as follows. The ammoniacal nickel (II)-containing solution should contain approximately equal concentrations of Ni and $NH_3$, typically about 50 g/L of each of Ni and $NH_3$, or in the range of about 40 to 50 g/L each. Preferably, the ammoniacal nickel (II)-containing solution comprises ammoniacal nickel (II) carbonate wherein the ammonia to nickel mole ratio is about 3:1 and the $CO_2$:Ni mole ratio is about 1:1. The solution should contain approximately equal concentrations of Ni, $NH_3$ and $CO_2$, typically about 50 g/L each, or in a range of about 40 to 50 g/L each. The solution is then clarified or filtered to ensure that it contains only nickel ions and is essentially free of metallic nickel. A soluble silver salt, exemplary of which would be silver sulphate or silver nitrate, is then added to the ammoniacal nickel carbonate solution to yield a silver to nickel weight ratio of about 1.0 to 10.0 grams silver per kilogram of nickel. Gelatin is added in an amount of 5.0 to 20.0 grams per kilogram of nickel, together with anthraquinone in an amount of 1.0 to 5.0 grams per kilogram of nickel. The ammoniacal nickel (II) carbonate solution, together with the catalytic reagents are then heated, with agitation and with a hydrogen overpressure in the range of 150 to 500 kPa, but preferably about 350 kPa, to a temperature in the range of 150° C. to 180° C., and reacted with hydrogen at a pressure of 3.0 MPa to 4.0 MPa, preferably at about 3.5 MPa, until the dissolved nickel (II) salt is reduced to nickel metal powder.

Thirdly, the present invention provides a unique method for controlling the particle size of the produced micron-sized nickel metal powder. This method is founded on the discovery that there exists a correlative relationship between the amount of silver added (i.e. grams of added soluble silver per kilogram of nickel (II)) and the ultimate particle size obtained. Additionally, it appears that a relationship exists between the silver content of the produced powder and the particle size and, also, that both the added silver concentration and the silver content of the powder, in combination, affects particle size. Moreover, increasing the amount of added silver decreases the particle size obtained. As will be evident to one skilled in the art there exists an upper limit of silver which may effectively be added, and without being bound by same, would appear to be of the order of 10 grams per kilogram of nickel (II). Clearly, therefore; this capability of producing a nickel metal powder having a predetermined particle size is most advantageous.

BRIEF DESCRIPTION OF THE DRAWINGS

The method of the invention will now be described with reference to the accompanying drawings, in which.

DESCRIPTION OF THE PREFERRED EMBODIMENT

Figure 1:
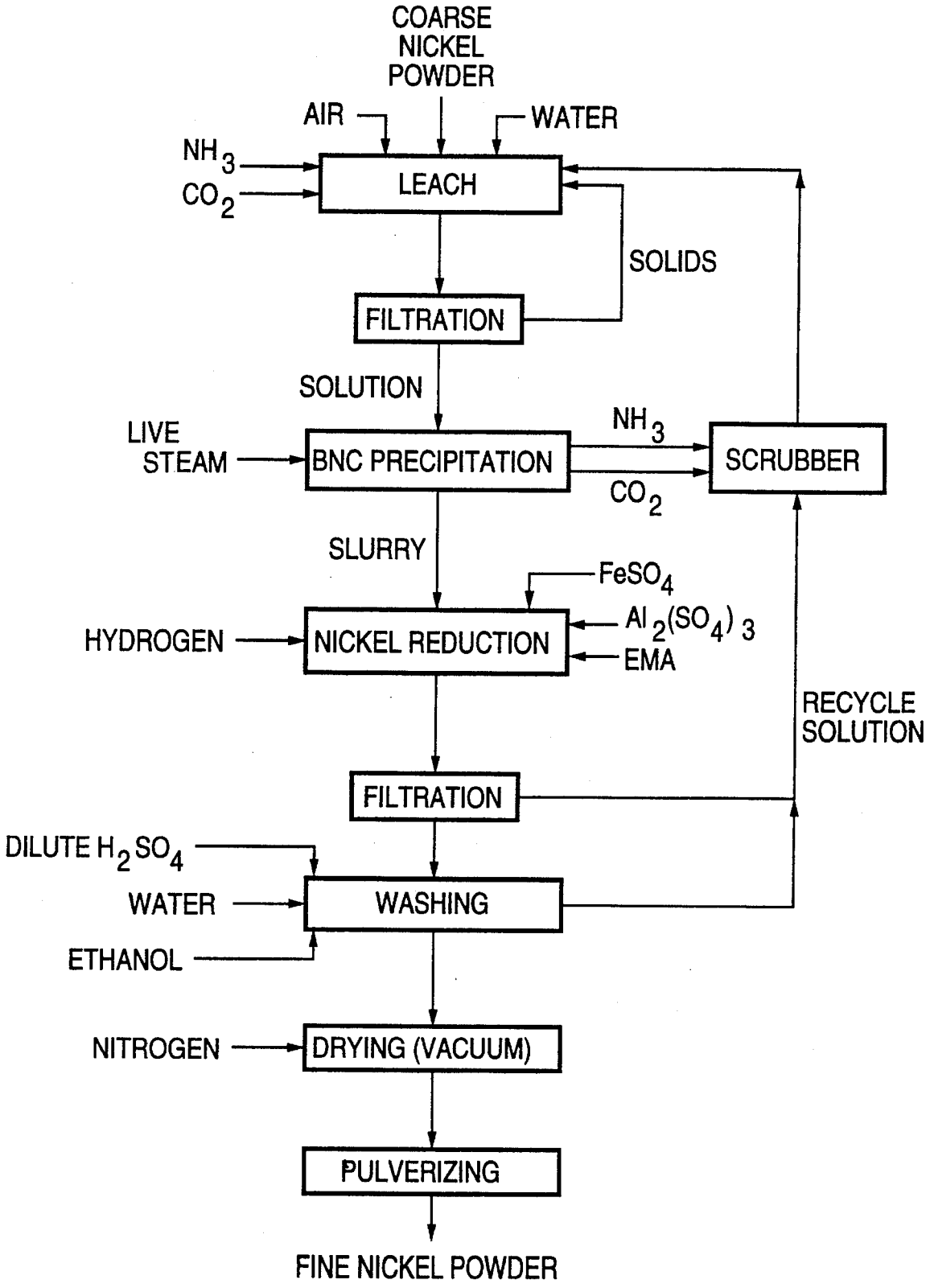
FIG. 1 is a process flowsheet of the commercially operated existing process for the production of micron-sized nickel metal powder.
Figure 2:
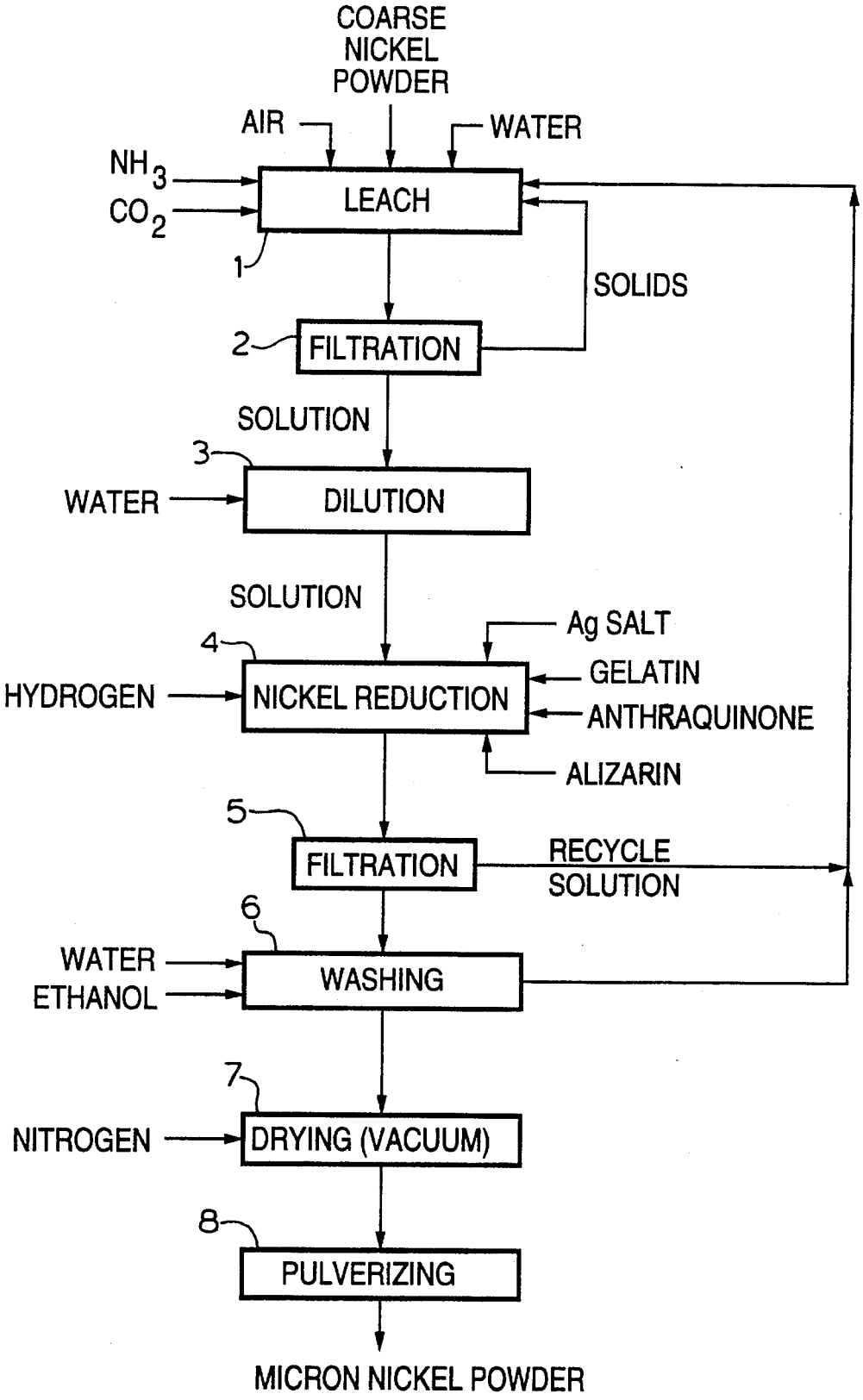
FIG. 2 is a process flowsheet of the present invention.
Figure 3:
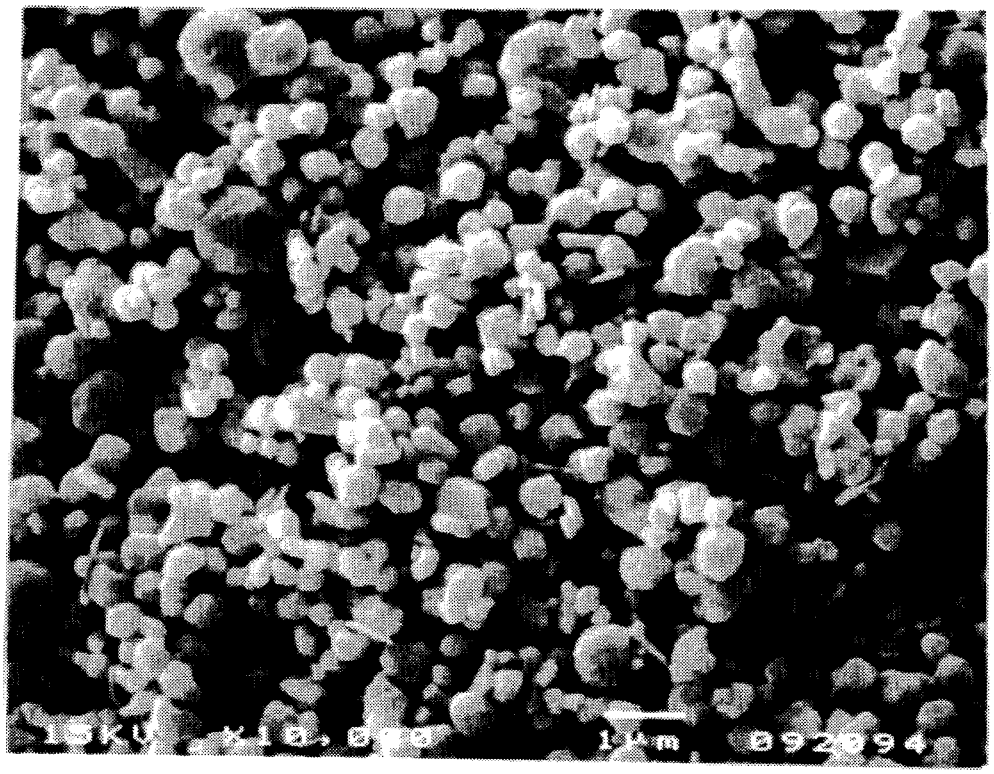
FIG. 3 is a photomicrograph of the nickel powder produced by the process of the prior art wherein $FeSO_4$ and $Al_2(SO_4)_3$ in admixture are utilized to seed the basic nickel (II) carbonate feedstock.
Figure 4:
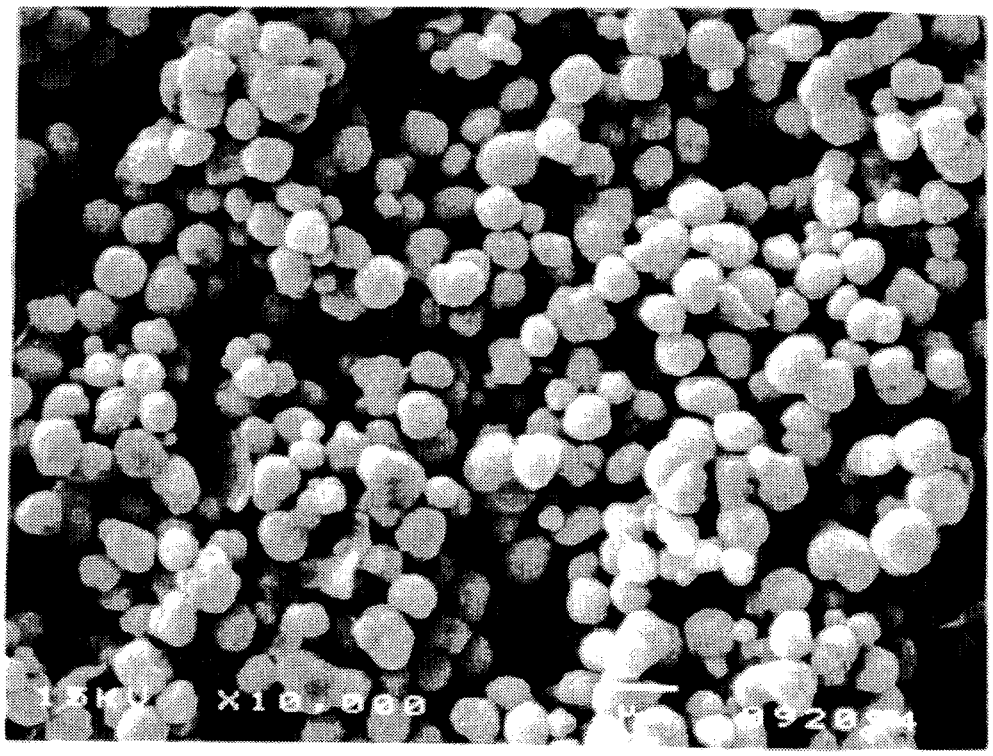
FIGS. 4 and 5 are photomicrographs illustrating the nickel metal powders prepared in accordance with the process of the present invention.
Figure 5:
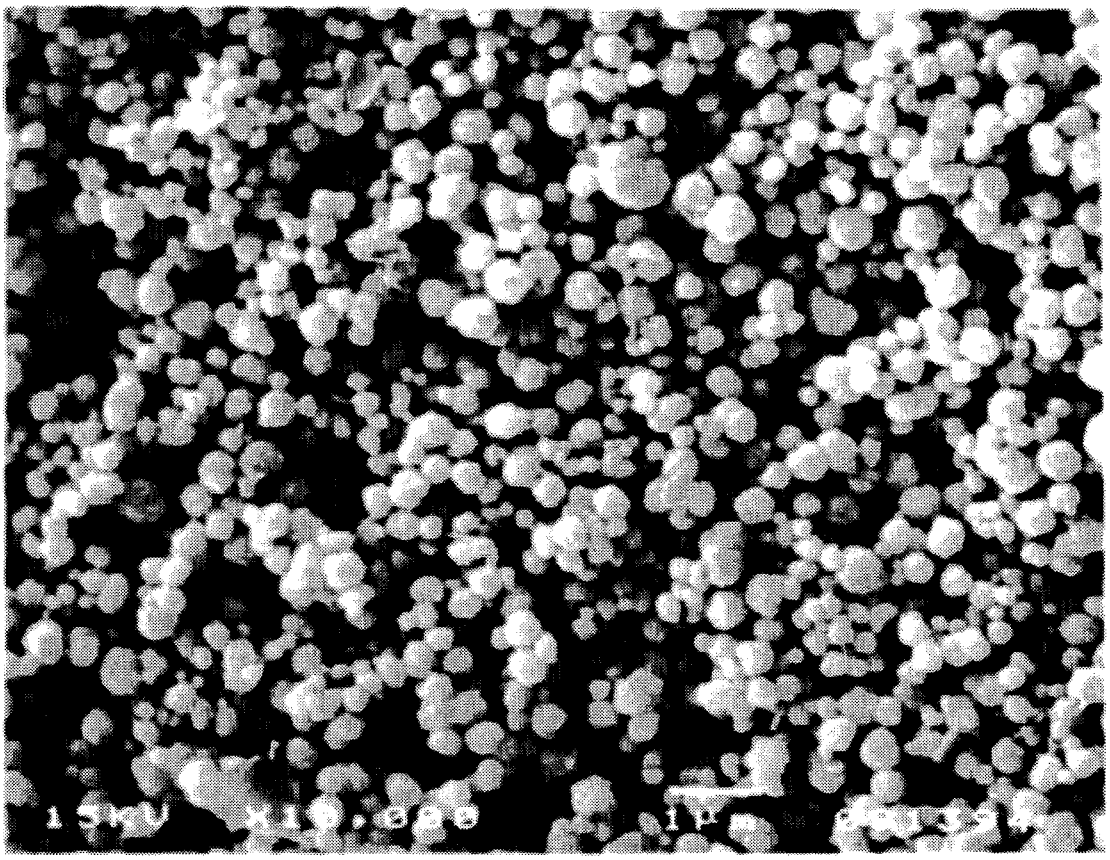

Having reference to the flowsheet of FIG. 2, a solution of nickel ammonium carbonate may be prepared in leach step 1 by dissolving coarse nickel powder in ammoniacal ammonium carbonate solution at 80° C. at elevated air pressure in an autoclave. This solution is then filtered or clarified in step 2 to ensure the removal of solids thereby leaving a solution which is essentially free of metallic nickel. The solution is then diluted in step 3 and charged in an autoclave (step 4) wherein the catalytic reagents are added.

A soluble silver salt, preferably silver sulphate or silver nitrate, is added in a ratio of about 1 to 10 grams of silver per kilogram of nickel (II). The amount of silver to be added will depend upon the desired particle size of the nickel metal powder.

More specifically, the amount of silver added would be dictated by the results given in Table 1 herebelow.

TABLE I

| Silver added g/kg Ni (II) | Fisher No. (microns) |
|---|---|
| 3.5 | 1.08 |
| 5.5 | 0.97 |
| 6.2 | 0.77 |
| 8.3 | 0.35 |

It has been found that the particle size of the nickel metal powder can be controlled to produce a powder having a particle size less than, or equal to, 1.0 μm by adding about 2.0 to 12.0 grams of silver sulphate per kilogram of nickel (II) or about 2.0 to 3.5 grams of silver nitrate per kilogram of nickel (II).

A dispersant such as gelatin, or bone glue, is added for agglomeration control. The agglomeration and growth control additives are added in an amount of from 5.0 to 20.0 grams per kilogram of nickel (II). A spheroid-promotion agent, preferably anthraquinone, is added to the solution to encourage the formation of spherical, high density nickel metal powder particles. Alternatively, derivatives of anthraquinone or alizarin may be utilized as such an agent. The anthraquinone is added in an amount in the range of 1.0 to 5.0 grams per kilogram of the nickel (II). A preferred amount of anthraquinone would be about 3 grams per kilogram of nickel (II). An alternatively preferred agent would be a mixture of anthraquinone and alizarin or alizarin per se.

The slurry containing the feedstock, catalyst and additives is heated, with agitation, to a temperature in the range of 150° to 180° C., under hydrogen pressure preferably about 3.5 MPa, for a time sufficient to reduce the nickel (II) to micron-sized nickel metal powder.

The nickel metal powder is then filtered (step 5) and subjected in step 6 to a water/ethanol wash. Solution recovered from steps 5 and 6 is recycled to leach step 1. The nickel metal powder is dried under vacuum with a nitrogen purge in step 7. The dried nickel metal powder is then pulverized in step 8 using a hammermill to break up agglomerated particles. Rod milling is not desirable because of the minor particle distortions which result.

The product and process of the invention will now be described with reference to the following non-limitative examples.

Experimental

EXAMPLE I (Prior art)

A solution of nickel ammonium carbonate containing 140 g/L Ni, 140 g/L $NH_3$, and 130 g/L $CO_2$, was prepared by dissolving coarse nickel powder in ammoniacal ammonium carbonate solution at 80° C. at an elevated air pressure in an autoclave. This solution was then treated by sparging in live steam to remove excess ammonia and carbon dioxide and precipitate all the dissolved nickel as basic nickel carbonate (BNC). A solution containing ferrous sulphate, aluminum sulphate and ethylene maleic anhydride (EMA) was added to the slurry of BNC, which was then charged to a 600 liter autoclave. The autoclave was then heated to 180° C. and pressurized with hydrogen to 3.5 kPa to reduce the BNC to metallic nickel powder. When the reduction was complete the autoclave was cooled and the slurry of nickel powder in barren liquor was discharged and filtered. The filter cake was washed with dilute sulphuric acid, followed by water and methyl alcohol, and dried under vacuum with a purge of nitrogen. The dry powder was pulverized in a hammer mill to break up agglomerates.

The powder product was analyzed in a Fisher sub-sieve size analyzer. The Fisher number corresponds to the approximate diameter of the powder particles in micrometers.

The chemical and physical analysis of the prior art nickel metal powder are given in Table II.

TABLE II

| | percent by weight | | | | | | | |
|---|---|---|---|---|---|---|---|---|
| CHEMICAL ANALYSIS | Ni | Al | Fe | Co | C | $O_2$ | S | Cu |
| | 98.5 | 0.2 | 0.4 | 0.3 | 0.2 | 0.9 | 0.07 | 0.005 |
| PHYSICAL ANALYSIS | A.D | | | T.D | | F.N | | |
| | 1.0–2.0 | | | 2.0–3.5 | | 0.7–1.2 | | |

wherein A.D. is the apparent density in g/cc, T.D is the tap density in g/cc, and F.N is the Fisher Number.

The particle shape, at 7000×magnification was determined as spheroidal shaped with a minimum/maximum diameter ratio of 0.8.

EXAMPLE II

A stock solution of nickel ammonium carbonate solution, containing 150 g/L Ni, 55 g/L $NH_3$ and 135 g/L $CO_2$, was prepared by dissolving coarse nickel powder in ammoniacal ammonium carbonate solution at 80° C. under 550 kPa air pressure in an autoclave. This solution was filtered and diluted with water to produce a series of solutions containing 35 to 50 g/L Ni, 35 to 50 g/L $NH_3$ and 32 to 47 g/L $CO_2$. Each diluted solution was prepared for reduction by the addition of a catalyst solution consisting of various combinations of silver sulphate, anthraquinone and gelatin dissolved in water, as specified in Table III. Each solution was charged to a 90 liter batch autoclave and heated to a temperature of 170° C. under steam pressure only. Hydrogen was then introduced to the autoclave at a total pressure of 3.5 MPa, to reduce the dissolved nickel to nickel powder. The quantity of powder produced in each reduction test ranged from 1.7 to 2.8 kg. When the reduction reaction was complete, the autoclave was cooled and discharged. The powder was filtered from the barren solution and washed with water followed by ethanol, and dried in a vacuum oven in an inert nitrogen atmosphere.

The powder products were analyzed on a Fisher sub-sieve size analyzer, and all showed Fisher numbers in the range 0.35 to 1.1 as shown in Table III. Scanning electron photomicrographs of these powders showed that the particle size ranged from 0.2 to 1.0 microns, with some agglomeration. A blend of the six finer powders analyzed 0.02% S, 0.17% C, 0.43% $O_2$ and 0.009% Fe.

TABLE III

| | Head Solution Composition g/L | | | Catalyst g/kg Ni | | | Product Fisher |
|---|---|---|---|---|---|---|---|
| Test | Ni | $NH_3$ | $CO_2$ | AQ. | Gelatin | $Ag_2SO_4$ | Number |
| 1 | 40 | 41 | 38 | 5 | 5 | 5 | 1.08 |
| 2 | 50 | 51 | 47 | 4 | 8 | 8 | 0.97 |
| 3 | 35 | 35 | 32 | 6 | 12 | 12 | 0.35 |
| 4 | 45 | 45 | 41 | 4.5 | 9 | 9 | 0.77 |
| 5 | 35 | 35 | 35 | 6 | 6 | 12 | 0.44 |
| 6 | 45 | 45 | 45 | 4.5 | 4.5 | 9 | 0.72 |
| 7 | 45 | 45 | 45 | 4.5 | 4.5 | 9 | 0.77 |

wherein AQ. is anthraquinone. The Fisher number corresponds to the approximate diameter of the powder particles in micrometers.

A definite and reproducible particle size correlation to the amount of silver sulphate added is evident as shown in Table IV.

TABLE IV

| | | | | |
|---|---|---|---|---|
| Silver Added, g/kg Ni | 3.5 | 5.5 | 6.2 | 8.3 |
| Fisher Number | 1.08 | 0.97 | 0.77 | 0.35 |

EXAMPLE III

A stock solution of nickel ammonium carbonate solution, containing 150 g/L Ni, 155 g/L $NH_3$ and 135 g/L $CO_2$, was prepared by dissolving coarse nickel powder in ammoniacal ammonium carbonate solution at 80° C. under 550 kPa air pressure in an autoclave. This solution was filtered and diluted with water to produce a large batch of solution containing 48 g/L Ni, 48 g/L $NH_3$ and 43 g/L $CO_2$. Each 60 liter charge of diluted solution was prepared for reduction by the addition of a catalyst solution consisting of various combinations of silver nitrate, gelatin and either anthraquinone, or alizarin or both, dissolved in water.

Each solution was charged into a 90 liter autoclave and heated to 175° C. Hydrogen was then introduced into the autoclave at a total pressure of 3.5 MPa, to reduce the dissolved nickel to nickel powder. The quantity of powder produced in each reduction test ranged from 900 to 1600 grams. The powder was filtered from the barren solution and washed with water followed by ethanol and dried in a vacuum oven with an inert nitrogen purge. Details of these tests and the physical properties of the nickel powders produced are given in Table V herebelow.

TABLE V

| | Test | | | | | |
|---|---|---|---|---|---|---|
| | 8 | 9 | 10 | 11 | 12 | 13 |
| | g/charge | | | | | |
| $AgNO_3$ | 10 | 10 | 10 | 10 | 10 | 10 |
| Gelatin | 10 | 10 | 20 | 20 | 20 | 20 |
| AQ | 5 | 5 | 5 | 5 | 5 | 5 |
| Alizarin | 0 | 0 | 0 | 0 | 1 | 1 |
| Fisher No. | 0.88 | 1.00 | 1.34 | 0.75 | 1.23 | 0.75 |
| Microtrac ™: | | | | | | |
| D-90, micron | 8.1 | 6.7 | 2.8 | 2.7 | 2.5 | 2.1 |
| D-50 | 2.5 | 2.5 | 1.4 | 1.4 | 1.2 | 1.0 |
| D-10 | 0.8 | 0.9 | 0.6 | 0.6 | 0.5 | 0.5 |
| A.D. g/cc | 0.91 | 1.09 | 1.46 | 1.22 | 1.64 | 1.45 |

The powders produced in these tests were blended and pulverized in a hammer mill to break up agglomerates, to simulate the commercial process. The Microtrac™ measurements, physical properties and chemical analyses obtained on these blended products are given in Tables VI and VII herebelow.

TABLE VI

| | Blend | | | | | |
|---|---|---|---|---|---|---|
| | A | B | C | D | E | F |
| MICROTRAC ™: micron | | | | | | |
| D - 10% | 0.55 | 0.54 | 0.56 | 0.57 | 0.53 | 0.51 |
| D - 50% | 1.40 | 1.30 | 1.43 | 1.38 | 1.23 | 0.99 |
| D - 90% | 2.90 | 2.66 | 2.82 | 2.68 | 2.49 | 2.07 |

TABLE VI-continued

| | Blend | | | | | |
|---|---|---|---|---|---|---|
| | A | B | C | D | E | F |
| D - 100% | 7.46 | 3.73 | 7.46 | 3.73 | 3.73 | 3.73 |
| PHYSICAL PROPERTIES | | | | | | |
| SG | 8.42 | 8.37 | 8.47 | 8.59 | 8.56 | 8.64 |
| S.A. $m^2/g$ | 2.35 | 3.15 | 1.97 | 1.58 | 3.03 | 2.07 |
| A.D. g/cc | 1.44 | 1.39 | 1.46 | 1.22 | 1.45 | 1.44 |
| T.D. g/cc | 2.67 | 2.53 | 2.82 | 2.11 | 2.74 | 2.56 |
| F.N. | 0.94 | 0.93 | 1.34 | 0.75 | 1.23 | 0.94 |

wherein SG is the specific gravity, S.A. is the surface area, F.N. is the Fisher number; A.D. is the apparent density; and T.D. is the tap density.

TABLE VII

| | Blend | | | | | |
|---|---|---|---|---|---|---|
| CHEMICAL ANALYSIS | A | B | C | D | E | F |
| | percent by weight | | | | | |
| Ni + Co | 98.2 | 98.1 | 98.7 | 98.8 | 99.4 | 99.0 |
| Co | 0.089 | 0.095 | 0.098 | 0.062 | 0.079 | 0.074 |
| Cu | 0.054 | 0.0076 | 0.013 | 0.011 | 0.002 | 0.001 |
| Fe | 0.008 | 0.010 | 0.030 | 0.0058 | 0.0075 | 0.0069 |
| Al | 0.0036 | 0.0031 | 0.0033 | 0.0036 | 0.0023 | 0.0029 |
| Ag | 0.034 | 0.054 | 0.035 | 0.136 | 0.062 | 0.172 |
| Si | 0.002 | 0.002 | 0.002 | 0.003 | — | — |
| Ca | 0.0034 | 0.0029 | 0.0025 | 0.0015 | — | — |
| Mg | 0.0010 | 0.0013 | 0.0008 | 0.0005 | 0.0008 | 0.0008 |
| Na | 0.0022 | 0.0061 | 0.0028 | 0.0027 | — | — |
| K | 0.0006 | 0.0002 | 0.0005 | 0.0003 | — | — |
| S | 0.0046 | 0.0014 | 0.004 | 0.008 | 0.0049 | 0.0053 |
| C | 0.184 | 0.225 | 0.142 | 0.168 | 0.214 | 0.207 |
| O | 1.1 | 1.2 | 0.72 | 0.59 | 0.38 | 0.62 |

EXAMPLE IV

A stock solution of nickel ammonium carbonate solution, containing 150 g/L Ni, 155 g/L $NH_3$ and 135 g/L $C0_2$, was prepared by dissolving coarse nickel powder in ammoniacal ammonium carbonate solution at 80° C. under 550 kPa air pressure in an autoclave. This solution was filtered and diluted with water to produce a large batch of solution containing 52 g/L Ni, 49 g/L $NH_3$ and 45 g/L $CO_2$. Each 550 liter charge of diluted solution was prepared for reduction by the addition of a catalyst solution consisting of various combinations of silver nitrate, gelatin and either anthraquinone or alizarin dissolved in water.

Each solution was charged into a 900 liter autoclave and heated to 160° C. with the application of a hydrogen overpressure of 350 kPa from the start of heating. Hydrogen was then introduced into the autoclave at a total pressure of 3.5 MPa, to reduce the dissolved nickel to nickel powder. The powder was filtered from the barren solution and washed with water followed by ethanol and dried in a vacuum oven with an inert nitrogen purge. Details of these tests and the physical properties of the nickel powders produced are given in Table VIII herebelow.

TABLE VIII

| | Test | | | | |
|---|---|---|---|---|---|
| | 14 | 15 | 16 | 17 | 18 |
| | | | g/kg Ni | | |
| $AgNO_3$, | 3.3 | 2.2 | 2.2 | 2.2 | 1.7 |
| Gelatin, | 7.0 | 7.0 | 7.0 | 10.4 | 7.0 |
| AQ, | 1.7 | 1.7 | 1.7 | 1.7 | 1.7 |
| Alizarin | 0.35 | 0.35 | 0.35 | 0.35 | 0.35 |
| Fisher No. | 0.67 | 0.75 | 1.02 | 0.69 | 1.40 |
| Microtrac*: | | | | | |
| D-10, micron | 0.74 | 0.77 | 0.95 | 0.76 | 0.98 |
| D-50 | 2.90 | 2.64 | 3.15 | 3.37 | 2.79 |
| D-90 | 9.66 | 9.32 | 8.19 | 15.42 | 5.78 |
| A.D. g/cc | 0.94 | 0.88 | 1.44 | 0.94 | 1.63 |

From the above results it will be observed that the optimum silver nitrate to nickel (II) ratio would appear to be between 2.0–3.5 grams per kilogram.

It will be understood, of course, that modifications can be made in the embodiment of the invention illustrated and described herein without departing from the scope and purview of the invention as defined by the appended claims.

I claim:

1. A process for the preparation of a micron-sized nickel metal powder from en ammoniacal nickel (II)-carbonate solution wherein said solution comprises substantially equal concentrations of Ni, $NH_3$ and $CO_2$ in the range of about 40 to 50 g/L, treating said ammoniacal nickel (II)-carbonate solution to produce an essentially metallic nickel-free solution; adding a silver compound to said solution to thereby provide a soluble silver to nickel weight ratio in the range of about 1 to 10 grams of silver per kilogram of nickel (II), adding an organic dispersant in an amount functional to control agglomeration of the nickel metal powder, adding an organic spheroid-promoting compound in an amount effective to maximize the spheroidal configuration of the nickel metal powder, and heating said solution, with agitation, and optionally with a hydrogen overpressure in the range of 150 to 500 kPa, to a temperature in the range of 150° to 180° C., and reacting said solution with hydrogen at a pressure of 3.0 to 4.0 MPa for a time sufficient to reduce the dissolved (II)-carbonate solution to a micron-sized nickel metal powder having a chemical composition which comprises nickel in the range of about 99.0 to 99.5 weight percent and including impurities comprising iron in the range of about 0.001 to 0.010 weight percent; aluminum in the range of about 0.0001 to 0.005 weight percent; carbon in the range of about 0.1 to 0.4 weight percent and silver in the range of about 0.01 to 0.2 weight percent, said nickel metal powder further having physical properties including having a surface area in the range of about 0.5 to 3.0 square meters per gram, an apparent density in the range of about 1.0 to 2.0 g/cc; a micron size range from between about 0.3 to 1.5 μm, and having a generally spheroidal configuration.

2. The process as set forth in claim 1 wherein said hydrogen overpressure during heating is about 350 kPa and said hydrogen pressure during nickel reduction is about 3.50 MPa.

3. The process as set forth in claim 1 wherein said dispersants are selected from the group consisting of gelatin, bone glue, and both gelatin and bone glue.

4. The process as set forth in claim 3 wherein the amount of added dispersant is in the range of about 5.0 to 20.0 grams per kilogram of nickel (II).

5. The process as set forth in claim 4 wherein the dispersant is gelatin.

6. The process as set forth in claim 3 wherein said spheroid-promoting agent is selected from the group consisting of anthraquinone, derivatives of anthraquinone, alizarin and both alizarin and anthraquinone.

7. The process as set forth in claim 3 wherein the spheroid-promoting agent is anthraquinone in an amount in the range of about 1.0 to 5.0 grams per kilogram of nickel (II).

8. The process as set forth in claim 1 wherein said organic dispersant comprises gelatin in an amount in the range of about 5.0 to 20.0 grams per kilogram of nickel (II); said spheroid-promoting compound comprises anthraquinone in an amount in the range of about 1.0 to 5.0 grams per kilogram of nickel (II); the hydrogen overpressure during heating being about 350 psi, and the hydrogen pressure during reduction being 3.5 MPa.

9. The process as set forth in claim 8 wherein the silver to nickel weight ratio is in the range of about 1.0 to 2.5 grams of silver per kilogram of nickel.

10. A method for controlling the particle size of a high purity sub-micron sized nickel powder which comprises in a process for the preparation of a micron nickel metal powder from an essentially metallic Ni-free ammoniacal nickel (II)-carbonate solution wherein said solution comprises substantially equal concentrations of Ni, $NH_3$ and $CO_2$ in the range of about 40 to 50 g/L, adding a silver compound to said solution to thereby provide a soluble silver to nickel weight ratio in an experimentally determined amount of silver per kilogram of nickel (II), adding an organic dispersant in an amount functional to control agglomeration of the nickel metal powder, adding an organic spheroid-promoting compound in an amount effective to maximize the spheroidal configuration of the nickel metal powder, with agitation, and heating said solution, optionally with a hydrogen overpressure in the range of 150 to 500 kPa, to a temperature in the range of 140° to 190° C., and reacting with hydrogen at a pressure of 3.5 to 6.0 MPa for a time sufficient to reduce the dissolved nickel (II)-carbonate solution to a nickel metal powder of specific particle size having a chemical composition which comprises nickel in the range of about 99.0 to 99.5 weight percent and including impurities comprising iron in the range of about 0.001 to 0.010 weight percent; aluminum in the range of about 0.0001 to 0.005 weight percent; carbon in the range of about 0.1 to 0.4 weight percent and silver in the range of about 0.01 to 0.2 weight percent, said nickel metal powder further having a physical properties including having a surface area in the range of about 0.5 to 3.0 square meters per gram, an apparent density in the range of about 1.0 to 2.0 g/cc, a sub-micron size less than or equal to 1.0 μm, and having a generally spheroidal configuration.

11. In a method for controlling the particle size of a micron-sized nickel metal powder, the process as set forth in claim 10 which comprises adding 1.0 to 10.0 grams of silver per kilogram of nickel (II) to thereby provide a nickel metal powder having a particle size less than, or equal to, 1.0 μm.

12. In a method for controlling the particle size of a micron-sized nickel metal powder, the process as set forth in claim 10 which comprises adding about 1.0 to 2.5 grams of silver per kg of nickel (II) to thereby provide a nickel metal powder having a particle size less than, or equal to, 1.0 μm.

13. In a method for controlling the particle size of a micro-sized nickel metal powder, the process as set forth in claim 10 which comprises adding about 2.0 to 3.5 grams of silver nitrate per kg of nickel (II) to thereby provide a nickel metal powder having a particle size less than, or equal to, 1.0 μm.

14. In a method for controlling the particle size of a micron-sized nickel metal powder, the process as set forth in claim 10 which comprises adding about 2.0 to 12.0 grams of silver sulphate per kg of nickel (II) to thereby provide a nickel metal powder having a particle size less than, or equal to, 1.0 μm.

* * * * *